United States Patent [19]

Phillips

[11] 4,207,855

[45] Jun. 17, 1980

[54] FUEL CONSERVATION SYSTEM FOR INTERNAL COMBUSTION ENGINES

[76] Inventor: Wayne A. Phillips, 10010 Memorial Rd., #1005, Houston, Tex. 77024

[21] Appl. No.: 875,165

[22] Filed: Feb. 6, 1978

[51] Int. Cl.[2] ..... F02D 9/00; F02D 17/02

[52] U.S. Cl. ..... 123/198 F; 123/105; 123/111; 123/169 V

[58] Field of Search ..... 123/198 F, 169 V, 198 DB, 123/105, 110, 111

[56] References Cited

U.S. PATENT DOCUMENTS

| | | | |
|---|---|---|---|
| 3,158,143 | 11/1964 | Heidner | 123/198 F |
| 4,018,204 | 4/1977 | Rand | 123/198 F |
| 4,061,055 | 12/1977 | Iizuka et al. | 123/198 F |
| 4,064,844 | 12/1977 | Matsumoto et al. | 123/198 F |
| 4,105,010 | 8/1978 | Rand | 123/198 F |

*Primary Examiner*—Ira S. Lazarus
*Attorney, Agent, or Firm*—William R. Laney

[57] ABSTRACT

A system is provided for varying the number of active cylinders in a multi-cylinder internal combustion engine, in response to the operating requirements of the engine. When the engine reaches that part of its operating range where the torque requirement is such that operation of all of the cylinders is not required to provide adequate and efficient power, certain cylinders are rendered inactive, thereby reducing the fuel consumed by the engine. A control system is provided which, upon sensing a reduced torque requirement upon the engine, activates a switch which de-energizes the spark generating electrodes of certain cylinders, and concurrently activates solenoid valve means whereby fuel vapor in the deactivated cylinders may be bypassed through the cylinders and returned to the fuel supply system of the engine for later use. In one embodiment of the system, novel spark producing means is provided which includes the fuel bypass valve means. The spark producing means is so constructed that it may be substituted for a conventional spark plug of an internal combustion engine thereby providing for simple and economical installation of the fuel conservation system upon existing internal combustion engines.

17 Claims, 2 Drawing Figures

FUEL CONSERVATION SYSTEM FOR INTERNAL COMBUSTION ENGINES

BACKGROUND OF THE INVENTION

1. Field of the Invention

This invention relates generally to methods and apparatus for conserving fuel in, and extending the operating life of, internal combustion engines and more particularly, but not by way of limitation, to methods and apparatus for selectively deactivating one or more cylinders of a multi-cylinder internal combustion engine in response to the torque requirements on said engine thereby reducing the fuel consumption of the engine.

2. Description of the Prior Art (Prior Art Statement)

The following statement is intended to be a Prior Art Statement in compliance with the guidance and requirements of 37 CFR Sections 1.56, 1.97 and 1.98 and with Section 609 of the Manual of Patent Examining Procedure.

U.S. Pat. No. 2,078,178 to Johnson shows a device where fuel is bypassed from the combustion chamber concurrent with a deactivation of the spark plug in that chamber. It will be noted, however, that the Johnson device is very dissimilar from the present invention, the principle dissimilarity being that the fuel bypass and ignition deactivation of the Johnson apparatus is not automatically provided in response to engine speed, engine torque or any other engine operating parameter. The fuel bypass and ignition deactivation of Johnson is provided by manual means only. That is, the valve 22 providing for fuel bypass is activated manually by turning the thumb screw 23 thereby moving the valve 22 to an open or closed position. When the valve 22 is moved to an open position, the extension 24 is concurrently moved into electrically grounding contact with the conductor 25 which is attached to the spark plug 15 thereby grounding out the plug and preventing sparking of the same. Furthermore, the Johnson device does not include any means by which fuel bypass can be accomplished in a conventional engine through an arrangement similar to the "spark valve" of the present invention.

U.S. Pat. No. 2,544,463 to Mallory shows a system for cutting off the fuel supply to an engine in conjunction with cutting off the electrical ignition to the engine.

A multitude of systems are provided in the prior art for controlling the ignition of an engine in response to engine speed. An example of such systems is U.S. Pat. No. 3,022,777 to McCloy. McCloy describes an internal combustion engine speed governing means which includes a normally open grounding circuit closable by a speed sensitive switch and communicating electrically with a commutator ring rotatable with the distributor which directs spark inducing circuits to the several cylinders of the engine. A conductor system is provided which connects the ring to such individual spark inducing circuits to cause intermittent interruption of the grounding circuit to that there is excluded therefrom, selected spark inducing circuits. In this way, selective cylinders are rendered temporarily inoperative in response to the engine speed, and the remaining cylinders continue to operate. By this means, the speed of the engine is governed.

Other systems in the prior art similar to McCloy, showing such ignition control are U.S. Pat. Nos. 3,974,805 to Kondo; 3,863,616 to Wood; 3,884,203 to Cliffgard, 3,703,889 to Bodig; 3,158,143 to Heidner, 2,656,827 to Conover; 1,624,975 to Reece; 1,603,744 to Burton; 1,390,376 to Oglesby; and 970,794 to Carlson.

A more refined ignition control system responsive to a combination of engine parameters is that shown in U.S. Pat. No. 4,003,354 to Canup. One of the parameters to which the Canup system is responsive is the torque load on the engine as shown by the torque sensor 48 of Canup.

Several devices have been seen in the prior art which provide means for bypassing unused fuel through a combustion cylinder of an engine. These have principally been found in the diesel engine art where electrical ignition means is not used. For example, U.S. Pat. No. 3,919,986 to Goto shows a system by means of which the output of a diesel engine is controlled by discharging a portion of the combustible mixture from the combustion chamber prior to the ignition thereof. By this means, the output of the Goto device is controlled. A similar concept is shown in U.S. Pat. No. 1,456,337 to Pullin. Additionally, U.S. Pat. No. 1,898,602 to Stamsvik shows a system wherein the flow of fuel to certain cylinders of a multi-cylindered engine is cut off at low engine speeds.

It is seen therefore that none of the apparatus of the prior art include a system wherein the explosive charge of selected cylinders is bypassed through the cylinder and returned to the fuel supply system, automatically in response to variable engine parameters.

SUMMARY OF THE INVENTION

A system is provided for varying the number of active cylinders in a multi-cylinder internal combustion engine, in response to the operating requirements upon the engine. When the engine reaches that part of its operating range where the torque requirement is such that operation of all of the cylinders is not required to provide adequate and efficient power, certain cylinders are rendered inactive and the fuel flow to those cylinders is recycled to the fuel supply system, thereby reducing the fuel consumed by the engine. A control system is provided which, upon sensing the low torque requirement upon the engine, activates a switch which de-energizes the spark generating electrodes of certain cylinders, and concurrently activates solenoid valve means whereby unburned fuel in the deactivated cylinders may be bypassed through the cylinders and returned to the fuel supply system of the engine for later use. Novel spark producing means is provided which includes the fuel bypass valve means. The spark producing means is so constructed that it may be substituted for a conventional spark plug of an internal combustion engine, thereby providing for simple and economical installation of the fuel conservation system upon existing internal combustion engines.

It is therefore a general object of the present invention to provide an improved fuel conservation apparatus for internal combustion engines.

A further object of the present invention is to provide means for automatically controlling combustion in preselected cylinders of a multi-cylindered engine in response to engine torque requirements.

Another object of the present invention is to provide means for concurrently deactivating the ignition system of a cylinder while bypassing a combustible fuel mixture through the cylinder.

Yet another object of the present invention is the provision of apparatus adaptable to a conventional engine, by means of which ignition of the cylinders is controlled while concurrently bypassing the combustible mixture through that orifice in the engine which conventionally houses the ignition spark producing means.

Other and further objects, features and advantages of the present invention will be readily apparent to those skilled in the art upon a reading of the description of preferred embodiments which follows when read with reference to the accompanying drawings.

DETAILED DESCRIPTION OF THE PREFERRED EMBODIMENTS OF THE INVENTION

Figure 1:
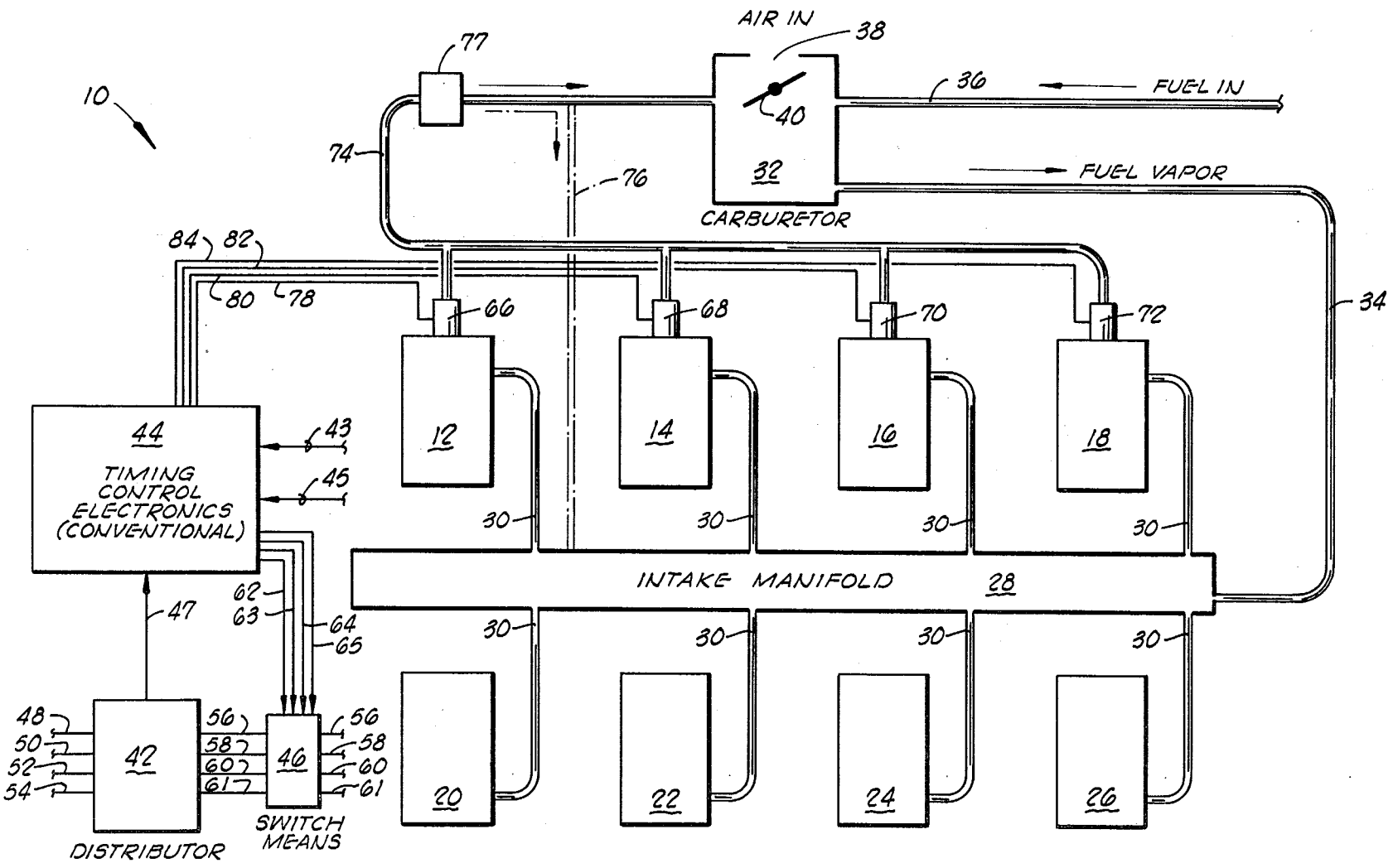
FIG. 1 is a schematic view of one embodiment of the fuel conservation system of the present invention, showing diagramatically the cylinders of the engine, the fuel supply system, and the ignition and fuel bypass control means of the present invention.

Referring now to the drawings and particularly to FIG. 1, the fuel conservation system of the present invention is shown and generally designated by the numeral 10. The system 10 includes combustion chambers 12, 14, 16, 18, 20, 22, 24 and 26. Each of the combustion chambers is connected to an intake manifold 28 by means of an intake passage 30. The intake manifold 28 is connected to a carburetor 32 by means of a fuel vapor supply line 34. Non-vaporized fuel is supplied to the carburetor 32 by means of a fuel inlet line 36 which is also connected to a fuel storage tank (not shown). Air, for mixture with the fuel to provide a combustible fuel vapor is provided to the carburetor 32 by means of the air inlet 38, the flow of such air being controlled by throttle valve 40. It will be noted that all of the components described to this point are those which are typically found in an internal combustion engine. Also electrical spark ignition of the combustible fuel vapor in each of the combustion chambers is provided by an ignition system which is controlled by means of the distributor 42.

The improvement on the conventional internal combustion engine which is provided by the present invention is a system which, in response to a preselected value of engine torque load, acts to conserve the fuel consumed by the engine by deactivating the ignition means of preselected cylinders, while concurrently bypassing the fuel vapor mixture through said cylinders and returning the same to the fuel supply system. This is accomplished in the following manner.

Conventional timing control electronics 44 are provided which include engine torque load sensing means and control apparatus responsive thereto for activating an electronic switch means 46 when the engine torque load reaches a preprogrammed operating range. In an automobile, for example, more torque is required to accelerate from zero velocity to cruising spped than is required to maintain cruising speed once it is attained. The timing control electronics 44 of the present invention therefore includes a torque load sensing means and control apparatus responsive to the sensing means, when the sensing means indicates a certain lower magnitude of torque load, to activate the switch means 46 which deactivates the ignition system of cylinders 12, 14, 16 and 18 while concurrently providing for bypass of the fuel vapor from those cylinders, as will be explained further below.

The torque load sensing means of the timing control electronics 44 can be of any of a number of conventional designs well known to those skilled in the art. A particularly appropriate torque sensing means for the present invention includes signal input means 43 and 45 which provide electrical inputs corresponding to throttle position and vehicle speed, respectively. Additionally, input means 47, connected to the distributor 42, provides an input signal corresponding to the engine RPM.

Torque, as well as each of those variables upon which torque load is dependent, has an influence upon the fuel economy of the engine. At low torque levels the individual cylinders of a multicylinder engine are not operating at their most efficient level. By reducing the number of operating cylinders, those cylinders which are operating are required to supply a greater portion of the torque required, and they operate in a more efficient manner thereby increasing the fuel economy of the engine.

A sensing transducer (not shown) connected to the input means 43 for sensing throttle position would preferrably be of the linear displacement type. The throttle position is an important variable upon which the amount of fuel supplied to the engine is dependent.

A sensing transducer (not shown) connected to the input means 45 for sensing vehicle speed is preferrably a rotating optical or magnetic transducer coupled to a speedometer cable of a conventional vehicle or to another vehicle component whose rotational speed is directly related to vehicle speed, such as an output shaft from a transmission.

The timing control electronics 44 is designed to sense the torque requirement of the engine based upon the input signals described above. Depending upon the sophistication and accuracy required, other vehicle parameters having an influence on engine torque requirements may be accounted for by providing appropriate sensing means and by appropriate modification of the timing control electronics 44.

The ignition system connecting the distributor 42 to the spark inducing means of each of the cylinders includes spark plug wires 48, 50, 52 and 54 leading respectively to cylinders 20, 22, 24 and 26. Those leads are connected to conventional spark producing means in a manner well known to the prior art. Additionally, spark plugs wires 56, 58, 60 and 61 are provided connecting the distributor 42 respectively to the spark producing means of cylinders 12, 14, 16, and 18. The switch means 46 is interconnected with spark plug wires 56, 58, 60 and 61 at a location intermediate the distributor 42 and the respective spark producing means of the cylinders, and is interconnected with the spark plug wires in such a manner that ignition signals from the distributor 42 can be interrupted by activation of the switch means 46.

The electronic switch means 46 contains four individual switches (not shown) connected to timing control electronics 44 by connecting means 62, 63, 64 and 65, and responsive to signals from timing control electronics 44 to de-energize the spark producing means of cylinders 12, 14, 16 and 18 by interruption of the signals carried by spark plug wires 56, 58, 60 and 61 respectively. De-energization is preferrably accomplished by grounding of the spark plug wires. In engines having an electronic ignition system, however, de-energization may be accomplished by controlling the low voltage input (not shown) to the distributor 42.

The timing control electronics 44 also controls the bypass system for the unused fuel vapor from cylinders 12, 14, 16 and 18, in the following manner. Each of the cylinders 12, 14, 16 and 18 includes a fuel bypass means 66, 68, 70 and 72, respectively. Each of the fuel bypass means is in fluid communication with its respective cylinder and with a fuel return line 74. By means of the fuel return line 74, unused fuel vapor is returned to the carburetor 32 as shown in solid lines, or alternatively, may be returned to the intake manifold 28 by means of the alternate return line 76, as shown in phantom lines.

It will be appreciated that depending upon the particular application of the fuel conservation system of the present invention, it may be desired to return the unused fuel vapor to one or more of several points within the fuel supply system. For example, if the operation of the engine is such that the combustible fuel vapor mixture passes through the cylinder 12, 14, 16 and 18 relatively unchanged, that is retaining the droplets of fuel suspended in the air, the fuel may be directly returned to the cylinders for combustion by means of either of the fuel return lines 74 or 76 as shown. However, if, in passing through the engine, the fuel vapor mixture begins to deteriorate substantially, that is if the fuel droplets coalesce to the point that the finely dispersed fuel and air mixture is lost, it may be necessary to return the unused fuel to a point upstream of the carburetor, i.e., to the fuel storage tank (not shown) upstream of the fuel inlet line 36. In this latter type of fuel return system the fuel vapor should be passed through a condensor (not shown) located intermediate of the fuel return line and the fuel storage tank (not shown).

In the various embodiments of a fuel return system described above, particularly the first two where fuel vapor is recycled to the carburetor or intake manifold, it is often desirable to include a conventional surge tank 77 to smooth out the pressure fluctuations in the fuel return system.

Each of the fuel bypass means 66, 68, 70 and 72 is controlled by the timing control electronics 44 by means of signals transmitted through electrical connecting means 78, 80, 82 and 84, respectively.

The operation of the fuel conservation system 10 can be described by the following example. In an automobile having a conventional multi-cylindered internal combustion engine, the timing control electronics 44 is set so that when the automobile reaches a cruising velocity and the torque load upon the engine falls below a sensed predetermined level, signals are sent to the switch means 46, thereby de-energizing the ignition means of one or more of the cylinders 12, 14, 16 and 18. Concurrently, signals are sent to the corresponding fuel bypass means 66, 68, 70 and 72, thereby activating the same and allowing the fuel vapor from the de-energized cylinders to be passed through the fuel bypass means into the fuel return lines 74 so that it may be recycled within the fuel supply system. In this manner, when the load requirements upon the engine are such that all eight of the cylinders are not required, some of the cylinders are taken out of operation thereby effectively providing an engine with a lesser number of operating cylinders, characterized by the attendant fuel economy. When the torque requirements on the engine rise above the preset level, for example when the automobile begins to climb a hill, the timing control electronics 44 once again sends signals to the switch means 46, thereby reactivating the ignition means of the previously de-energized cylinders. Concurrently signals are sent to the fuel bypass means, thereby closing the same so that all cylinders are once again in operation and the full power of an eight cylinder engine is provided.

Figure 2:
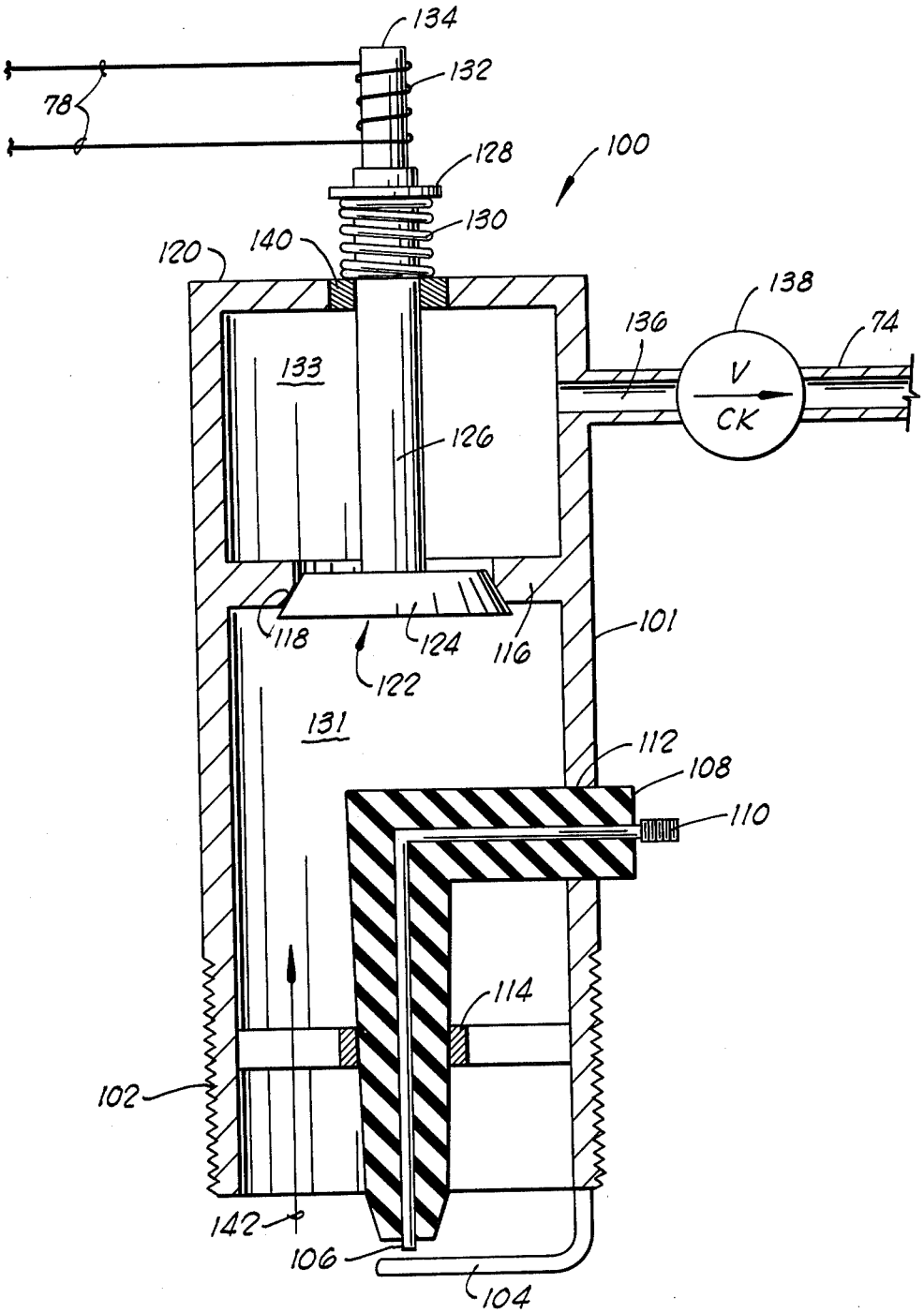
FIG. 2 is an elevational partly sectional, partly schematic view of an embodiment of the present invention by means of which the explosive mixture from a cylinder is bypassed through that orifice of the engine which conventionally contains the spark plug.

Referring now to FIG. 2, a presently preferred embodiment of the fuel bypass means of the present invention is shown in a partially schematic manner and is generally designated by the numeral 100. The fuel bypass means 100 will hereinafter be referred to as the spark valve 100. The spark valve 100 is so constructed that it may be placed in a conventional internal combustion engine in place of the conventional spark plug. The spark valve 100 includes a casing 101 which threadedly engages a conventional spark plug orifice (not shown) by means of its threaded end 102. In structural and electrical connection to the threaded end 102 is a grounded electrode 104 which is similar to the analogous component of a conventional spark plug. Spaced from the grounded electrode 104 is a high voltage electrode 106 which is encased in an electrode insulator 108. An end of the high voltage electrode 106 is provided with connector means 110 by means of which the high voltage electrode 106 is electrically connected to one of the spark plug wires 56, 58, 60 or 61. For the sake of brevity, further connections of the spark valve 100 with associated components of the fuel conservation system 10 will be referred to only with respect to the cylinder 12. The connector means 110 is therefore connected to the spark plug wire 56. The components of the spark valve 100 discussed to this point are essentially the same as the analogous components of a conventional spark plug.

The high voltage electrode 106 and the electrode connector 108 pass through an orifice 112 in the side of the casing 101. It is necessary that the electrode insulator 108 sealingly engage the orifice 112 so that high pressure gases cannot escape therebetween, as will be further shown below. The electrode insulator 108 is held within the casing 101 by means of a supporting protrusion 114. Internal to the casing 101 at an intermediate portion thereof is a dividing wall 116 which includes a valve seat 118. The casing 101 also includes a second end 120. Held within the second end 120 and the dividing wall 116 is a valve member generally designated by the numeral 122 which includes a valve head 124 and a valve stem 126. At the end of the valve stem 126, opposite the valve head 124, is attached a valve retainer 128 which forcibly engages a resilient valve spring 130 located external of the casing 101 between the retainer 128 and the second end 120. The valve head 124 intimately contacts the valve seat 118 when the valve is in a closed position. The valve member 122 will normally be retained in a closed position by means of the resilient valve spring 130. The valve spring 130 is a helical spring which is in a state of compression thereby forcibly urging the valve head 124 into contact with the valve seat 118.

The valve member 122 and the dividing wall 116 separate the interior of the casing 101 into a first chamber 131 and a second chamber 133.

When it is desired to open the valve member 122 and permit fuel vapor to be bypassed through the spark valve 100, solenoid windings 132 are energized. Within the windings 132 is located a solenoid core 134 which is connected to the valve stem 126. When windings 132 are energized, the core 134 and the valve stem 126 are urged downwardly so that the valve head 124 moves away from the valve seat 128. The solenoid windings 132 are connected to conventional timing control electronics 44 by means of the electrical connecting means 78. It is understood that the solenoid windings 132 and core 134 are shown only in a schematic manner.

Communicating with the second chamber 133 is a bypass orifice 136 leading to the fuel return line 74 of FIG. 1. The bypass orifice 136 may also be referred to as a fluid outlet. Intermediate of the orifice 136 and the return line 74 is a one-way check valve 138 for allowing flow of unburned fuel vapor from the orifice 136 to the return line 74.

Seal means 140 are disposed between the valve stem 126 and the second end 120 of the casing 101 to prevent the escape of high pressure exhaust gases around the valve stem.

In the operation of the spark valve 100, when the valve member 122 is in a closed position—that is, when the valve head 124 is intimately contacting the valve seat 118—the spark valve 100 operates in the same manner as does a conventional spark plug. That is, a spark is produced between the grounding electrode 104 and the high voltage electrode 106, thereby igniting fuel in the cylinder 12 and powering the engine.

When the voltage to the electrode 106 is interrupted by the switch means 46 as controlled by the timing control electronics 44, however, the solenoid windings 132 are concurrently energized by a similar signal from the timing control electronics 44 by means of the electrical connecting means 78, thereby causing the valve head 124 to move away from the valve seat 118 and permitting fuel from the cylinder 12 to be bypassed through the spark valve 100 and to the fuel return line 74. The flow of fuel vapor from the cylinder 12 to the fuel return line 74 is by means of the following path. Fuel vapor from the cylinder 12 moves into the casing 101 through the fluid inlet at its threaded end 102 as indicated by the arrow 142. The fuel then flows through the annular opening between the valve seat 118 and the valve head 124, thence through the bypass orifice 136, and through the check valve 138 to the fuel return line 74.

The amount of fuel vapor which can flow through the spark valve 100 is a function of the cross-sectional area of the flow passage. Therefore, the bypass orifice 136 will desirably be as large as possible. This bypass orifice is intended to be shown only in a diagramatic fashion, and it is understood that it preferably is constructed in such a manner as to provide the least resistance to flow of fuel vapor from the cylinder 12 to the fuel return line 74. The specific construction, of course, depends upon the physical structure of the engine to which the spark valve 100 is added.

It is also noted that the broad concept of the fuel conservation system 10 includes bypass means 66 constructed to be completely separate from the spark producing means of the cylinder 12. This is accomplished, in one form, by an additional valve in the cylinder head. It can also be accomplished by means of a T-shaped manifold having a first end for threadedly engaging a conventional spark plug hole, a second end connected to a solenoid operated bypass valve and a third end having disposed therein a spark plug of conventional design. The specific embodiment to be used for a given application will depend upon the performance requirements of the engine.

Thus, the apparatus for fuel conservation in an internal combustion engine of the present invention is well adapted to carry out the objects and attain the ends and advantages mentioned, as well as those inherent therein. While certain embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A fuel conservation system for an internal combustion engine, comprising:

means for bypassing fuel through the engine to a fuel return system;

means for interrupting operation of a fuel ignition means of said engine; and control means for automatically and concurrently activating said fuel bypass means and said ignition interruption means in response to an engine parameter.

2. The apparatus of claim 1 wherein said ignition interruption means is further characterized as comprising:

a spark inducing signal distributor;

spark producing means;

means for electrically connecting said spark inducing signal distributor to a spark producing means; and switch means, connected to said control means, and electrically attached to said connecting means intermediate said distributor and said spark producing means, for alternately energizing and de-energizing said spark producing means, in response to the engine parameter.

3. The apparatus of claim 1 wherein said fuel bypass means is further characterized as comprising:

valve means in fluid communication with a cylinder of said engine; and a fuel bypass orifice for providing fluid communication between said valve means and a fuel return line, so that fuel vapor may flow from said cylinder, through said valve means, to said fuel return line.

4. The apparatus of claim 3 further comprising:

a one way check valve located in fluid communication with, and intermediate of, said fuel bypass orifice and said fuel return line, so that fuel may only flow from said fuel bypass orifice to said fuel return line and said fuel return system.

5. The apparatus of claim 1 wherein said fuel bypass means comprises:

a casing:

an inlet in said casing for providing fluid communication with a cylinder of said engine;

valve means within said casing dividing said casing into a first chamber, within which said inlet is disposed, and a second chamber, said second chamber being in fluid communication with said first chamber when said valve is in an open position and being in fluid isolation from said first chamber when said valve is in a closed position; and a fluid outlet for communicating said second chamber with the fuel return system so that when said valve is in an open position fuel vapor can flow from said cylinder, through said inlet, thence through said valve, thence through said fluid outlet to said fuel return system.

6. The apparatus of claim 5 wherein said fuel bypass means is further comprised of:
solenoid means for selectively moving said valve alternately between the open position and the closed position; and
means for electrically connecting said solenoid means to said control means.

7. The apparatus of claim 6 wherein said fuel bypass means is further comprised of:
spark producing means disposed within said first chamber; and
means for providing an electrical connection between said spark producing means and said ignition interruption means.

8. A fuel conservation system for a vehicle having a multi-cylinder internal combustion engine, comprising:
means for sensing a plurality of engine parameters having an influence upon the fuel economy of the engine;
means for bypassing fuel through one of the cylinders of the engine to a fuel return system;
means for de-energizing an ignition means of said one cylinder; and
control means for automatically and concurrently activating said fuel bypass means and said de-energizing means in response to a signal from said sensing means.

9. The apparatus of claim 8 wherein said plurality of engine parameters further comprises:
throttle position;
engine speed; and
vehicle speed.

10. The apparatus of claim 8 wherein said fuel bypass means further comprises:
a casing;
fluid inlet means for providing fluid communication between said one cylinder and the interior of said casing;
fluid outlet means for providing fluid communication between said interior of said casing, and the fuel return system; and
valve means disposed in said casing dividing the casing into a first chamber in fluid communication with the inlet and a second chamber in fluid communication with the outlet, said chambers being in fluid communication when said valve is in an open position and in fluid isolation when said valve is in a closed position.

11. The apparatus of claim 10 further comprising:
spark producing means disposed in said first chamber; and
electrical connecting means connecting said de-energizing means and said spark producing means.

12. A spark valve for use in a fuel conservation system, comprising:
a casing including a threaded end for connection with a conventional spark plug orifice of an internal combustion engine;
valve means disposed in said casing, separating an interior of said casing into first and second chambers, said valve providing fluid communication between said chambers when said valve is in an open position, and fluid isolation between said chambers when said valve is in a closed position;
a fuel vapor inlet disposed in said first chamber for providing fluid communication with a cylinder of said engine;
a fuel vapor outlet in said second chamber to provide fluid communication with a fuel return system; and
spark producing means disposed within said first chamber; and
a one way check valve connected to said fuel vapor outlet so that fuel may flow only from said second chamber to said fuel return system.

13. The spark valve of claim 12 which is further comprised of:
resilient spring means for urging said valve means into a closed position; and
solenoid means for selectively moving said valve means between the open and the closed position.

14. The spark valve of claim 12 wherein said spark producing means is further comprised of:
a ground electrode in electrical connection with said casing;
a high voltage electrode, electrically insulated from said casing; and
means for electrically connecting said high voltage electrode to a high voltage source.

15. A method for conserving fluid in a multi-cylinder internal combustion engine having electrical ignition means, comprising:
sensing an engine parameter;
interrupting said electrical ignition means of certain preselected cylinders of said engine in response to a predetermined change in said sensed engine parameter;
bypassing, through said preselected cylinders, fuel vapor from said cylinders, concurrently with the interruption of said ignition means; and
returning said fuel vapor to a fuel system.

16. The method of claim 15 further comprising the steps of:
setting a control level for said engine parameter, in an electronic control system;
transmitting an electrical signal from said control system to a switch for interrupting said electrical ignition, when said engine parameter passes said control level; and
energizing a solenoid valve by a second signal from said control means to provide fluid communication between said preselected cylinders and a fuel return system.

17. The method of claim 16 wherein said step of sensing an engine parameter is further characterized as sensing the engine torque.

* * * * *